US012398548B2

(12) United States Patent
Attwal et al.

(10) Patent No.: US 12,398,548 B2
(45) Date of Patent: Aug. 26, 2025

(54) PORTABLE BASIN ASSEMBLY AND METHOD OF USE THEREOF

(71) Applicant: SINGH ATTWAL PTY LTD, Carrara (AU)

(72) Inventors: Harjeet Attwal, Robina (AU); Rebecca Gavan, Robina (AU)

(73) Assignee: Singh Attwal Pty Ltd, Carrara (AU)

( * ) Notice: Subject to any disclaimer, the term of this patent is extended or adjusted under 35 U.S.C. 154(b) by 131 days.

(21) Appl. No.: 18/289,178

(22) PCT Filed: May 3, 2022

(86) PCT No.: PCT/AU2022/050411
§ 371 (c)(1),
(2) Date: Nov. 1, 2023

(87) PCT Pub. No.: WO2022/232872
PCT Pub. Date: Nov. 10, 2022

(65) Prior Publication Data

US 2024/0218646 A1 Jul. 4, 2024

(30) Foreign Application Priority Data

May 3, 2021 (AU) ..... 2021901311

(51) Int. Cl.
*E03C 1/182* (2006.01)
*A45D 19/04* (2006.01)
(Continued)

(52) U.S. Cl.
CPC ..... *E03C 1/182* (2013.01); *A45D 19/04* (2013.01); *E03C 1/326* (2013.01); *A45D 19/08* (2013.01)

(58) Field of Classification Search
CPC ... E03C 1/14; E03C 1/18; E03C 1/182; E03C 1/326; E03C 2201/90; A45D 19/04; A45D 19/06; A45D 19/08
(Continued)

(56) References Cited

U.S. PATENT DOCUMENTS 4,998,302 A 3/1991 Silva
5,305,481 A * 4/1994 Nebb ..... A45D 19/04 4/518

(Continued)

FOREIGN PATENT DOCUMENTS

AU 2017100566 A4 6/2017
CN 207506108 U 6/2018
JP 2001133043 A 5/2001

OTHER PUBLICATIONS

International Search Report and Written Opinion for International Application No. PCT/AU2022/050411, dated Aug. 9, 2022 (7 pages).

(Continued)

*Primary Examiner* — Tuan N Nguyen
(74) *Attorney, Agent, or Firm* — Hartman Global IP Law; Gary M. Hartman; Domenica N.S. Hartman

(57) ABSTRACT

A portable basin assembly and methods of use thereof are provided. The portable basin assembly includes a frame configured to convey the assembly along a support surface; a basin having a waste mounted atop the frame; at least one water outlet for directing a flow of water into the basin; and a mounting system for mounting at least one of a waste water tank and a clean water tank to the assembly. The mounting system includes: a docking interface for docking with and fluidly connecting at least one of the waste water tank to receive water from the waste of the basin and the clean water tank for providing a source of clean water; and at least one alignment member for aligning the at least one (Continued)

of the waste water tank and the clean water tank relative to the frame and the docking interface.

20 Claims, 7 Drawing Sheets

(51) Int. Cl.
*A45D 19/08* (2006.01)
*E03C 1/326* (2006.01)

(58) Field of Classification Search
USPC ..... 4/625–627, 515–521
See application file for complete search history.

(56) References Cited

U.S. PATENT DOCUMENTS 5,526,539 A * 6/1996 Bower ..... A45D 19/04 312/317.3
5,813,063 A 9/1998 Watkins et al.
6,173,458 B1 * 1/2001 Maddux ..... A47K 1/02 4/625
7,802,327 B1 9/2010 Moceri et al.
10,463,550 B1 11/2019 Shekarchi
11,641,982 B2 * 5/2023 Hayden ..... A47K 1/02 4/625
2003/0019031 A1 * 1/2003 Mosis ..... E03C 1/18 4/625
2005/0086734 A1 4/2005 Thies

OTHER PUBLICATIONS

International Preliminary Report on Patentability for International Application No. PCT/AU2022/050411, dated Dec. 13, 2022 ( 5 pages).
European Search Report for Application No. 22798052.1, dated Sep. 30, 2024, 7 pages.

* cited by examiner

PORTABLE BASIN ASSEMBLY AND METHOD OF USE THEREOF

CROSS REFERENCE TO RELATED APPLICATIONS

This application claims the benefit of PCT/AU2022/050411 filed May 3, 2022, having a priority claim to Australian Provisional Application No. 2021901311 filed May 3, 2021. The contents of these prior patent documents are incorporated herein by reference.

TECHNICAL FIELD

The present invention relates to a portable basin assembly and methods of use thereof.

BACKGROUND

Home-based and mobile hair salons are becoming increasingly popular, particularly amongst the elderly, sick and time poor and especially due to the covid-19 pandemic.

However, a problem with such salons is that they generally do not offer the same experience that traditional salons offer.

For example, in some scenarios home-based and/or mobile hairdressers may wash their client's hair over a bath or sink in a premise. However, this often leads to the hairdresser to cutting hair in either the bathroom or kitchen of the premise, which is unprofessional, undesirable and often can result in longer wash times, discomfort to the client and an uneven shampoo and clean.

In other scenarios, a home-based hairdresser may install a professional salon setup, including salon basin, in their own home. However, this option is expensive and permanent requiring a plumber to plumb the basin to a water supply and drainage line. Moreover, in many such scenarios, a hairdresser may only temporarily practice from home, and the installation of a professional hair salon setup may represent an excessive and unnecessary expense.

In yet other scenarios for both home-based and mobile hairdressers, a mobile or portable salon setup may be used. In such scenarios, the mobile or portable salon setup may be directly attached to a sink, which again limits the hairdresser to cutting hair in either a bathroom or kitchen of a premise and again may lead to longer wash times, discomfort to the client and an uneven shampoo and clean.

In other such scenarios, the setups are stand lone units as for example described in U.S. Pat. No. 7,469,430. However, the inventor has generally found that such mobile or portable salon setups, including the stand alone units, still do not provide a genuine salon experience. In particular, the setups tends to be designed more for portability, and typically are formed of lightweight materials, such as, e.g., plastic, which can lack the firmness, rigidity and stability of professional salon setups.

The inventor(s) have addressed one or more of the shortcomings and disadvantages by virtue of its portable salon assembly as disclosed in Australian Innovation Patent No. 2017100566, which is herein incorporated by reference in its entirety. However, the inventor(s) has recognised that further refinements of the invention are required in order to improve the home salon experience.

It will be clearly understood that, if a prior art publication is referred to herein, this reference does not constitute an admission that the publication forms part of the common general knowledge in the art in Australia or in any other country.

SUMMARY OF INVENTION

Embodiments of the present invention provide a portable basin assembly, a mounting system and a method of use, which may at least partially address one or more of the problems or deficiencies mentioned above or which may provide the public with a useful or commercial choice.

According to a first aspect of the present invention, there is provided a portable basin assembly including:

- a frame;
- a basin having a waste mounted atop the frame;
- at least one water outlet for directing a flow of water into the basin; and
- a mounting system for mounting at least one of a waste water tank and a clean water tank to the assembly, said mounting system including:
  - a docking interface for docking with and fluidly connecting at least one of the waste water tank to receive water from the waste of the basin and the clean water tank for providing a source of clean water; and
  - at least one alignment member for aligning the at least one of the waste water tank and the clean water tank relative to the frame and the docking interface.

According to a second aspect of the present invention, there is provided a mounting system for mounting at least one of waste water tank and a clean water tank to a portable basin assembly, said system including:

- a docking interface for fluidly connecting at least one of the waste water tank to receive waste water from a waste of a basin of the assembly and the clean water tank for providing a source of clean water to the assembly; and
- at least one alignment member for aligning the at least one of the waste water tank and the clean water tank relative to the frame of the assembly and the docking interface.

Preferably wherein the docking interface of the mounting system docks with a receiving interface provided on the at least one of the waste water tank and the clean water tank.

According to a third aspect of the present invention, there is provided a tank for use with the assembly of the first aspect, said tank adapted to hold a volume of a fluid and including:

- at least one receiving interface for mating with the docking interface of the mounting system of the assembly and fluidly connecting the tank to the assembly; and
- at least one alignment groove for at least partially receiving the at least one alignment member of the mounting system of the assembly and aligning the tank and the receiving interface relative to the frame and the docking interface of the assembly.

Advantageously, the portable basin assembly of the present invention provides a stand alone salon setup that can be readily used by home-based or mobile hairdressers. The assembly can be simply positioned in a desired location and used without the need for the hairdresser to have the assembly permanently installed (i.e., plumbed in). Moreover, by being portable, the assembly can be moved away and stowed when not in use, and the hairdresser is not confined to cutting hair in the bathroom, kitchen or any other room with a basin. Furthermore, the mounting system of the present invention provides a simple and efficient means for a user to simply roll in and out, relative to the assembly, new and used tanks without the need for lifting or alignment of the tanks relative to the assembly. Moreover, the docking interface ensures the tank(s) are fluidly connected to at least the at least one water outlet without the need for physically inserting a draw tube into the container(s).

As indicated above, the present invention provides a portable basin assembly including a frame and a mounting system for mounting at least one tank to the basin assembly so that the tank is in fluid communication with at least one of the waste of the basin and the at least one water outlet. The portable basin assembly will preferably be for use as a portable salon basin assembly, and it will therefore be convenient to describe the assembly with reference to this example application. However, a person skilled in the art will appreciate that the portable basin assembly is capable of broader applications, such as, e.g., as a portable basin in the food, retail, beauty, hospitality, and health service industries where access to a fixed basin is not possible.

As indicated, the assembly includes a frame for supporting the basin atop a support surface and for at least partially receiving and mounting at least one of the waste water tank and the clean water tank, preferably both.

The frame may be of any suitable size, shape and construction, and may be formed from any suitable material or materials.

Generally, the frame may be formed from metal and/or plastic material or materials, preferably metal material or materials.

The frame may define an upper surface atop of which the basin may be mounted, an opposed lower surface, a front end, an opposed rear end and opposed sides. A longitudinal axis of the frame may extend between the opposed sides.

The frame may be formed from two or more frame members joined together.

For example, the frame may include at least a pair of longitudinally extending frame members extending between the opposed sides and defining the front and rear ends. The pair of frame members may be joined together by one or more transversely extending cross frame members.

The various frame members may be joined together using conventional welding techniques, joining components and/or with one or more mechanical fasteners.

In some embodiments, the frame may include a lower pair of longitudinally extending frame members extending between the opposed sides and defining the lower surface and an upper pair of longitudinally extending frame members extending between the opposed sides and defining the upper surface. The lower and upper pairs of longitudinally extending frame members may together define the front and rear ends. Each pair of frame members may be joined together by one or more transversely extending cross frame members as previously described. Further, the pairs of frame members may be joined together by one or more vertically extending frame members defining a height of the frame.

Again, the various frame members may be joined together using conventional welding techniques, joining components and/or with one or more mechanical fasteners.

The frame members may each of be of a tubular construction, solid construction, plate construction or any combination thereof, preferably tubular with a substantially rectangular cross section.

As indicated, the frame may have an elongate shape of suitable width, length and height to support the basin and allow a user to comfortably access the basin.

The frame may have a length defined between the opposed sides of about 1,000 mm, about 1,100 mm, about 1,200 mm, about 1,300 mm, about 1,400 mm, about 1,500 mm, about 1,600 mm, about 1,700 mm, about 1,800 mm, about 1,900 mm, about 2,000 mm, about 2,100 mm, about 2,200 mm, about 2,300 mm, about 2,400 mm, about 2,500 mm, about 2,600 mm, about 2,700 mm, about 2,800 mm, about 2,900 mm or about 3,000 mm or more.

The frame may have a width defined between the front and rear ends of about 750 mm, about 760, about 770 mm, about 780 mm, about 790 mm, about 800 mm, about 810 mm, about 820 mm, about 830 mm, about 840 mm, about 850 mm, about 860 mm, about 870 mm, about 880 mm, about 890 mm, about 900 mm, about 910 mm, about 920 mm, about 930 mm, about 940 mm, about 950 mm, about 960 mm, about 970 mm, about 980 mm, about 990 mm, about 1,000 mm, about 1,010 mm, about 1,020 mm, about 1,030 mm, about 1,040 mm, about 1,050 mm, about 1,060 mm, about 1,070 mm, about 1,080 mm, about 1,090 mm, about 1,100 mm, about 1,110 mm, about 1,120 mm, about 1,130 mm, about 1,140 mm, about 1,150 mm, about 1,160 mm, about 1,170 mm, about 1,180 mm, about 1,190 mm, or about 1,200 mm or more.

The frame may have a height as defined between the lower and upper surfaces of about 850 mm, about 860 mm, about 870 mm, about 880 mm, about 890 mm, about 900 mm, about 910 mm, about 920 mm, about 930 mm, about 940 mm, about 950 mm, about 960 mm, about 970 mm, about 980 mm, about 990 mm, about 1,000 mm, about 1,010 mm, about 1,020 mm, about 1,030 mm, about 1,040 mm, about 1,050 mm, about 1,060 mm, about 1,070 mm, about 1,080 mm, about 1,090 mm, or about 1,100 mm or more.

The frame may include wheels for moving the frame (and conveying the assembly) along a support surface. The wheels may be located on, or mounted to, an underside or the lower surface of the frame. The wheels may be mounted directly or indirectly to the frame.

The frame may include any suitable number of wheels. For example, the frame may include two wheels, three wheels, four wheels, five wheels, six wheels, seven wheels, eight wheels, nine wheels or even 10 wheels.

Each wheel may include a brake so that the frame and the assembly may be parked in a desired location.

In some embodiments, the frame may include at least four wheels, preferably each wheel may be located at or near a corner of the frame.

Each wheel may be mounted to the lower surface of the frame such that the wheel may be able to swivel about a vertical axis. Preferably, each wheel may include a swivel caster, more preferably a height adjustable swivel caster.

In some embodiments, the frame may include one or more feet for supporting the frame and other components of the assembly atop a support surface.

The one or more feet may be of any suitable size, shape and construction and may be operatively associated with the frame in any suitable way.

Generally, the one or more feet may be formed from rubber, metal or plastic material or materials.

The feet may be located on, or mounted to, an underside or the lower surface of the frame. The feet may be mounted directly or indirectly to the frame.

The frame may include any suitable number of feet. For example, the frame may include two feet, three feet, four feet, five feet, six feet, seven feet, eight feet, nine feet or even 10 feet.

In some embodiments, the frame may include at least four feet, preferably each foot may be located at or near a corner of the frame.

Each foot may be mounted to the lower surface of the frame. Preferably, each foot may be height adjustable, for example by rotating the foot relative to the frame.

In some embodiments, the assembly may further include a housing having one or more panels mounted to the frame for concealing internal features of the assembly and/or providing a desired aesthetic look.

The one or more panels may be of any suitable size, shape and construction and may be formed from any suitable material or materials, such as, e.g., wood, plastic or metal material or materials.

Likewise, the one or more panels may be mounted to the frame in any suitable way.

For example, in some such embodiments, the one or more panels may be fastened to the frame with one or more mechanical and/or chemical fasteners as known in the art.

In preferred such embodiments, panels may be mounted on the upper surface, and the front and rear ends of the frame.

In some such embodiments, one or more of the panels or portions thereof may be pivotally fastened to the frame or adjacent panels so as to function as doors or access hatches operable between open and closed positions to enable a user to access internal contents of the assembly.

For example, doors or access hatches may be provided on any one of the opposed sides and the front and rear ends of the frame, typically the front end and/or the opposed sides. In some embodiments, each door may include a handle, lever or opening for gripping and opening the door relative to the assembly. In other embodiments, each door may include a push button release mechanism for opening the door relative to the assembly. In yet other embodiments, each door may include an electronic touch button opening mechanism for opening the door relative to the assembly.

In some embodiments, the frame and/or the housing of the assembly may together define at least one tank receiving bay, preferably two tank receiving bays. The tank receiving bays may be configured to receive a tank therein, preferably slidably received or rolled into the bays. The tank receiving bays may preferably be located at each of the sides of the frame.

As indicated, the assembly includes a basin having a waste mountable atop the frame. The basin may be of any suitable size, shape and construction and may be formed from any suitable material or materials, typically stainless steel or ceramic, preferably ceramic.

The basin may include a base having the waste, a rim and at least one sidewall extending upwardly from the base to the rim. The rim may extend from an upper portion of the at least one sidewall and may extend along an edge of the at least one sidewall.

The base may be of any suitable shape. For example, the base may have a substantially circular, oval, triangular, polygonal, oblong or rectangular shape. The waste may preferably be centrally located within the base.

In some embodiments, the rim and/or the at least one sidewall of the basin may include at least one recessed rim portion. The at least one recessed rim portion may be sized and shaped to receive or at least partially accommodate the back of a neck of a person having his or her hair washed or rinsed in the basin. In preferred embodiments, the at least one recessed rim portion may be substantially U-shaped enabling a person to rest his or her neck in a crook of the U-shaped recessed rim portion while his or her head is positioned over the basin.

In some such embodiments, the assembly may further include a padded portion configured to fit over the at least one recessed rim portion. The padded portion may be formed from plastic and/or rubber and may provide further comfort to the person having his or her hair rinsed and/or washed.

In some embodiments, the assembly may include more than one basin. For example, the assembly may include at least two or more basins. In such embodiments, the two or more basins may be arranged side-by-side to enable greater functionality for an operator or operators to, e.g., wash and/or rinse two people's hair simultaneously or consecutively, or to provide at least one further functioning basin to clean accessories, such as, e.g., combs, scissors, razors and the like, while still having a primary basin to rinse and/or wash a person's hair.

The basin may be mounted atop the frame in any suitable way. For example, the basin may be directly or indirectly mounted, preferably the latter.

Likewise, the basin may be mounted in any suitable location atop the frame. For example, the basin may be centrally mounted atop the upper surface of the frame. Conversely, the basin may be mounted at or near either of the opposed sides of the frame.

In preferred embodiments, the basin may be pivotally mounted atop the frame such that the basin is tiltable about a central vertical axis. The basin may be pivotally mounted in any suitable way known in the art. Preferably, the basin may be pivotally mounted so that the basin is tiltable towards and away from a person having his or her hair rinsed and/or washed. Typically, the basin may be pivotally mounted by a mounting mechanism that also enables the basin to be secured or locked in a desired position.

In some embodiments, the basin may further be rotatably mounted atop the frame such that the basin is rotatable relative to the frame. Again, the base may typically be rotatably mounted by a mounting mechanism that also enables the basin to be secured or locked in a desired position.

As indicated, the assembly includes at least one water outlet for directing a flow of water into the basin. The at least one water outlet may be of any suitable size, shape and construction.

In some embodiments, the at least one water outlet may be in fluid communication with the source of clean water, preferably in the clean water tank. The at least one water outlet may be in fluid communication with the source of clean water via a passage, pipe or tubing extending between the at least one water outlet and the source of clean water, preferably the clean water tank.

In other embodiments, the assembly may further include a pump in fluid communication with the at least one water outlet and the source of clean water. The pump may be of any suitable form to pump water under pressure to the at least one water outlet. Typically, the pump may be an electric pump, preferably capable of producing a high pressure water stream, e.g., for massaging the scalp of a person. In some embodiments, the pump may have adjustable flow settings so that the pressure of water pumped to the at least one water outlet may be adjustable, such as, e.g., between low, medium and high pressure streams.

Again, the at least one water outlet, the pump and the source of clean water may be interconnected via a passage, pipe or tubing extending therebetween.

Usually, a single water outlet may be associated with the basin, although embodiments in which multiple water outlets may be associated with the basin are also envisaged.

In some embodiments, the at least one water outlet may be located at or near an edge of the basin or adjacent the basin, preferably on a side of the basin opposite or nearly opposite the at least one recessed rim portion.

In other embodiments, the at least one water outlet may be located in the upper surface of the frame or a panel mounted thereon. The at least one water outlet may be connectable to an applicator and/or hose extending up to the basin.

In some embodiments, the flow of water through the at least one water outlet may be selectively controlled by a water outlet valve. Any suitable type of valve may be used.

Typically, the water outlet valve may include: a valve seat located within or associated with the passage, pipe or tubing extending from the at least one water outlet to the pump or the source of clean water; a sealing member moveable into or out of engagement with the valve seat, and an actuating mechanism for moving the sealing member into or out of engagement with the valve seat. The actuating mechanism may include an operable lever, handle or knob or a solenoid.

In some embodiments, the water outlet valve may be a solenoid valve. In such embodiments, the solenoid valve may be associated with a button configured to be depressed to activate the actuating mechanism, preferably a push button.

In other embodiments, the flow of water through the at least one water outlet may be selectively controlled by selective control of the pump. In such embodiments, the pump may include an activation/deactivation switch, button or lever operatively associated with the basin, preferably a button, more preferably a push button.

In some embodiments, the assembly may include at least two water outlets. For example, the assembly may include a Tee fitting for dividing the flow of water from the source of clean water to a first water outlet and a second water outlet. The first water outlet may include a first water outlet valve and the second water outlet may include a second water outlet valve.

In some such embodiments, the second water outlet may be associated with a water regulating arrangement for heating or chilling the flow of water.

Typically, the at least one water outlet may further include an applicator extending from, or connectable to, the at least one water outlet for directing the flow of water at the basin. The applicator may extend from, or be connected to, the at least one water outlet by a tube, pipe or hose. The applicator may be associated together with the water outlet valve or they may be positioned apart from one another.

In some embodiments in which the assembly includes at least two water outlets, each water outlet may include an applicator.

In other embodiments in which the assembly includes at least two water outlets, a single applicator may be connectable to both water outlets via a mixing valve, for example. The mixing valve may be connectable to the applicator by a tube, pipe or hose. Any suitable type of mixing valve may be used.

The applicator may be of any suitable size, shape and construction for directing at least one jet of water. The applicator may typically be configured to be, in use, handheld.

For example, in some embodiments, the applicator may include a shower head or spray nozzle. The shower head or spray nozzle may or may not be adjustable to provide a desired spray pattern.

In other embodiments, the applicator may include a faucet, preferably an extendible or pull-out faucet capable of being temporarily pulled away from the basin.

As indicated, in some embodiments, the assembly may further include a water regulating arrangement configured to maintain water at a desired temperature, preferably the flow of water into the basin. The water regulating arrangement may be of any suitable form known in the art and may typically be operatively associated with the clean water tank or a passage, pipe or tubing extending between the clean water tank and the at least one water outlet.

The water regulating arrangement may include at least one temperature sensor and a heating or chilling element operatively connected with a thermostat circuit. The thermostat circuit may include a temperature control for an operator to set a desired temperature.

In some embodiments, the water regulating arrangement may be operatively associated with the source of clean water, e.g., a tank heater.

In other embodiments, the water regulating arrangement may include a tank heater jacket operatively associated with the source of clean water.

In other embodiments, the water regulating arrangement may be a tankless instant hot water heater located in line between the source of clean water and the at least one water outlet.

In some embodiments, the temperature control may be located within the housing.

In other embodiments, the temperature control may be located on an external surface of the housing, preferably on the upper surface. In preferred such embodiments, the temperature control may include an interface for an operator to interact with and set a desired temperature and/or a flow rate of the flow water provided via the at least one water outlet to the basin.

In use, a user may set the desired temperature to be a cold temperature or a warm/hot temperature, for example. The cold temperature may be between about 4° C. and about 20° C., typically between about 10° C. and about 20° C., preferably between about 15° C. and about 20° C. The warm/hot temperature may be between about 25° C. and about 40° C., typically between about 30° C. and about 40° C., preferably between about 35° C. and about 40° C.

In some embodiments, the applicator may include, or be associated with, a display for displaying a temperature of the water flowing out via the applicator. The display may preferably be an LED display.

As indicated, the assembly may include at least one of a waste water tank and a clean water tank, preferably both.

Each tank may be of any suitable size, shape and construction and may be formed from any suitable material or materials, typically metal and/or plastic material or materials, preferably plastic material or materials.

Likewise, each tank may hold any suitable volume of water. For example, each tank may hold at least 5 L, at least 10 L, at least 15 L, at least 20 L, at least 20 L, at least 25 L, at least 30 L, at least 35 L, at least 40 L, at least 45 L, at least 50 L, at least 55 L, at least 60 L, at least 65 L, at least 70 L, at least 75 L, at least 80 L, at least 85 L, at least 90 L, at least 95 L, at least 100 L, at least 105 L, at least 110 L, at least 115 L, at least 120 L, at least 125 L, at least 130 L, at least 135 L, at least 140 L, at least 145 L, at least 150 L, at least 155 L, at least 160 L, at least 165 L, at least 170 L, at least 175 L, at least 180 L, at least 185 L, at least 190 L, at least 195 L, at least 200 L, at least 205 L, at least 210 L, at least 215 L, at least 220 L, at least 225 L, at least 230 L, at last 235 L, at least 240 L, at least 245 L or even at least 250 L of water.

Generally, the tanks are configured to be at least partially received within the frame of the assembly via the mounting system so that the tanks are arranged beneath the basin for providing clean water and for receiving waste water, respectively. Typically, the tanks are entirely received within the frame of the assembly in a side-by-side arrangement, preferably each tank is received via a tank receiving bay as previously described.

Each tank may have a substantially cuboidal shape. For example, each tank may include a base wall, an opposed upper wall and at least four sidewalls extending therebetween. The at least four sidewalls may include an inner sidewall configured to be received first in the assembly, an opposed outer sidewall and opposed side sidewalls.

In some embodiments, each tank may include a side panel operatively associated with the outer sidewall of the tank, preferably fastened thereto with one or more mechanical and/or chemical fasteners. In use, the side panel may rest flush with a remainder of the housing of the assembly when the tank is fully received within the frame of the assembly.

In some embodiments, at least one of the tanks may include a first inlet opening for filling and/or receiving waste water from the waste of the basin. The first inlet opening may be located in or near the upper wall of the tank.

For example, in some embodiments in which the tank is the waste water tank, the first inlet opening may align with the waste of the basin and/or a passage, pipe or tubing extending therefrom so that waste water may drain into the tank from the waste of the base via the first inlet opening.

The inlet opening may be connectable to a closing member, such as, e.g., a lid, a cover, a cap or a plug, for sealing the inlet opening when being transported and/or not being used.

In some embodiments, at least one of the tanks may include an outlet opening for providing the flow of water to the at least one water outlet. The outlet opening may be located on at least one of the four sidewalls, typically on a lower portion of the sidewall at or near the base wall, preferably the inner sidewall.

The outlet opening may preferably include at least one sealing member to facilitate engagement of the outlet opening with the docking interface of the mounting system. This will be described in detail later.

Further, in some such embodiments, the outlet opening may include at least one valve for closing the outlet opening when not engaged with the docking interface. The at least one valve may preferably sit in line with the outlet opening. The at least one valve may include a valve seat located within or associated with the outlet opening; a sealing member moveable into or out of engagement with the valve seat, and an actuating mechanism for moving the sealing member into or out of engagement with the valve seat. The actuating mechanism may include a spring or like biasing member.

Suitably, in some such embodiments, the at least one valve of the outlet opening may be spring-loaded, preferably a spring-loaded ball valve.

Preferably, the outlet opening may include a female formation for mating, or engaging, with a male formation of the docking interface.

The tanks may include wheels for moving each tank along a support surface. The wheels may be located on, or mounted to, an underside of the base wall of the tank. The wheels may be mounted directly or indirectly to the tank.

The tank may include any suitable number of wheels. For example, the tank may include two wheels, three wheels or four wheels or more, preferably four wheels.

Each wheel may include a brake so that the tank may be parked in a desired location.

In some embodiments, each tank may include at least four wheels, preferably each wheel being located at or near a corner of the base wall of the tank.

Each wheel may be mounted to the lower surface of the base wall such that the wheel may be able to swivel about a vertical axis. Preferably, each wheel may include a swivel caster.

In some embodiments, the assembly may be conveyed across a support surface by the wheels mounted to the underside of each tank. In such embodiments, the frame may include one or more feet, which may be raised prior to moving the assembly and then lowered to re-engage the support surface once the assembly is parked in a desired location.

As indicated, the assembly includes a mounting system for mounting at least one of a waste water tank and a clean water tank to the assembly so that the tank is in fluid communication with at least one of the waste of the basin and the at least one water outlet.

The mounting system may be of any suitable size, shape and construction.

The mounting system and parts thereof may or may not be of integral formation with each of the frame of the assembly and the at least one of a waste water tank and a clean water tank.

Suitably, the mounting system may enable at least one of the waste water tank and the clean water tank to be slid or rolled into the frame of the assembly, preferably both. The tanks may be slid or rolled into the frame via access doors located on any one of the front end, rear end and opposed sides, preferably the sides.

As indicated, the mounting system includes a docking interface for docking with and fluidly connecting the at least one of waste water tank and the clean water tank, preferably at least the clean water tank, more preferably via the receiving interface provided on the clean water tank.

The docking interface may be of any suitable size, shape and configuration and may be located in any suitable location within the assembly, preferably centrally located between the opposed sides of the frame.

The docking interface may be configured to dock, engage, mate or connect with the receiving interface associated with the at least one of waste water tank and the clean water tank, preferably the clean water tank.

The receiving interface may preferably include the outlet opening as previously described. Like the docking interface, the receiving interface and parts thereof may or may not be of integral formation with the tank.

Generally, the docking interface may include a water inlet connectable to the outlet opening of the at least one waste water tank and the clean water tank, preferably the clean water tank.

The water inlet may be of any suitable size, shape and construction to form a fluid-tight connection with the outlet opening and fluidly connect the at least one of the tanks with the at least one water outlet, preferably the clean water tank.

In some embodiments, the water inlet and the outlet opening of the tank may connect together by way of a connecting mechanism or part thereof. The connecting mechanism or parts thereof may or may not be of integral formation with each of the water inlet and the outlet opening.

For example, in some such embodiments, the connecting mechanism may include a first part associated with the water inlet and a second part connectable to the first part and associated with the outlet opening.

The connecting mechanism may include mateable male and female portions that couple together, such as, e.g., a threaded connection, an interference (snap-fit) connection, a bayonet-type connection or a friction fit-type connection.

In some such embodiments, the first part of the connecting mechanism associated with the water inlet may include a male formation configured to be inserted into, or coupled with, a female formation of the second part of the connecting mechanism associated with the outlet opening.

In other such embodiments, the first part of the connecting mechanism may include a female formation configured to at least partially receive or be coupled with a male formation of the second part of the connecting mechanism.

In some embodiments, the water inlet may include a plug formation configured to be at least partially inserted into the outlet opening of the tank to fluidly connect the tank with the at least one water outlet, preferably via an interference (snap-fit) connection or friction fit-type connection.

In preferred embodiments, the water inlet and the outlet opening may each include part of a quick connect fitting. The water inlet may preferably include a male quick connect fitting connectable to a female quick connect fitting associated with the outlet opening.

The water inlet may preferably include a sealing member extending at least partially about the plug formation, such as, e.g., a washer.

In use, when the clean water tank is aligned and slid or rolled into the assembly, the male quick connect fitting of the water inlet may be inserted into the female quick connect fitting of the outlet opening of the tank thereby fluidly connecting with the outlet opening and allowing a source of clean water to exit the tank via the outlet opening and be conveyed to the at least one water outlet, preferably via the pump.

In some embodiments, the docking interface may further include a bracket on which the water inlet is mounted. The bracket may be of any suitable size, shape and construction.

Typically, the bracket may be fastened or joined to a cross frame member of the frame and positioned about midway between the opposed sides of the frame for engaging the docking interface with the at least one of the tanks, preferably the clean water tank. The bracket may be fastened or joined using conventional welding techniques and/or with one or more mechanical fasteners.

In some such embodiments, the bracket may include a stepped central portion on which the water inlet may be mounted so that the water inlet protrudes forward of the docking interface for at least partial insertion into the corresponding outlet opening of the at least one tank.

In other such embodiments, the bracket may include three portions when viewed in cross section: a first portion, a second portion and a third portion that together form the bracket. The second portion may be stepped relative to the first and third portions, which may be co-planar. Again, the water inlet may be mounted on the stepped second portion for engagement with the outlet opening of the receiving interface of the clean water tank.

In yet other such embodiments, the bracket may be a top hat bracket with the water inlet mounted on a stepped central portion of the bracket for engagement with the outlet opening of the receiving interface of the clean water tank.

As indicated, the mounting system further includes at least one alignment member for aligning the at least one of the waste water tank and the clean water tank relative to the frame and the docking interface, preferably the clean water tank. Although, the at least one alignment member of the mounting system may also align the waste water tank relative to the assembly for receiving waste water via the waste of the basin.

The alignment member may be of any suitable size, shape and construction and may be associated with any one of the frame, the docking interface and the at least one of the waste water tank and the clean water tank. Likewise, the alignment member may or may not be of integral construction with any one of the frame, the docking interface and the at least one of the waste water tank and the clean water tank.

In some embodiments, the at least one alignment member may include one or more protruding ridges extending along an inner surface of any one of the front end, the rear end and the opposed sides of the frame. The one or more protruding ridges may at least partially extend in a substantially horizontal orientation along the inner surface and may be configured to align relative to and be at least partially received in corresponding grooves or channels defined along at least one of the opposed side sidewalls of the tank or tanks.

Conversely, in other embodiments, the at least one alignment member may include one or more protruding ridges extending along an outer surface of at least one of the opposed side sidewalls of the tank or tanks. The one or more protruding ridges may at least partially extend in a substantially horizontal orientation along the outer surface of at least one of the opposed side sidewalls of the tank or tanks and be configured to align relative to and be at least partially received in corresponding grooves or channels defined along an inner surface of any one of the front end, the rear end and the opposed sides of the frame.

In yet other embodiments, the at least one alignment member may include one or more protrusions protruding from the docking interface and configured to align relative to and be at least partially receiving within corresponding depressions formed in the receiving interface or the inner sidewall of the tank or tanks, when the tank or tanks are fully slid or rolled into the assembly.

Conversely in yet further embodiments, the at least one alignment member may include one or more protrusions protruding outwardly from the inner wall of the tank or tanks or the receiving interface of the tank or tanks and configured to align relative to and be at least partially received within corresponding depressions formed in the docking interface, when the tank or tanks are fully slid or rolled into the assembly.

In some embodiments, the mounting system may include more than one alignment member. For example, the mounting system may include at least two, at least three, at least four or even at least five alignment members.

In some embodiments, the at least one alignment member of the mounting system may include at least a pair of opposed protruding ridges protruding inwards from an inner surface of the front and rear ends of the frame, respectively, and a pair of protrusions protruding from the docking interface on opposing sides of the water inlet.

The pair of opposed protruding ridges may extend at least partially across a central portion of inner surfaces of both the front and rear ends of the frame. Corresponding grooves defined at least partially along the opposed side sidewalls of the tanks from the inner sidewall at least partially towards the outer sidewall are configured to align relative to and at least partially receive the protruding ridges when the tanks are inserted into the assembly via the opposed sides.

The pair of protrusions may protrude outwardly from the docking interface.

Typically, the protrusions may be arranged in a horizontal arrangement on opposing sides of the water inlet of the docking interface, preferably on the opposing end portions of the bracket of the docketing interface (i.e., not the stepped central portion).

Each protrusion may be of any suitable size, shape and construction.

Generally, each protrusion may include a pair of opposed ends and an elongate body extending therebetween. The pair of opposed ends may include a proximal end mounted to the docking interface and an opposed distal end, preferably rounded distal end. The elongate body may have a substantially circular profile shape. A distal portion of the body may taper to the distal end.

In some embodiments, the elongate body of each protrusion may include a cylindrical proximal portion and a conical distal portion that tapers towards the distal end. The proximal portion and the distal portion may be delineated by a shoulder of greater diameter than the proximal portion.

In some embodiments, each protrusion may be slidable between a retracted position and an extended position.

In some such embodiments, each protrusion may be mounted to a base mount mounted to the docking interface and the protrusion may be slidable relative to the base mount between the retracted position and the extended position.

In other such embodiments, each protrusion may be slidably mounted to the docking interface between the retracted and extended positions.

In such embodiments, each protrusion may further include one or more biasing mechanisms or members so that movement to the retracted position works against the force of the biasing mechanism or member. The biasing mechanism or member may include one or more springs, such as, e.g., coil springs. The biasing mechanism or member may be mounted over the base mount between the docking interface and distal portion of the protrusion. Conversely, the biasing mechanism or member may be mounted about the proximal portion of the body between the docking interface and the shoulder of the protrusion.

Of course, a person skilled in the art will appreciate that other types of biasing mechanisms or members may be used, such as, e.g., magnets or magnetized elements and the like.

As indicated, each protrusion is configured to align relative to and be at least partially received in corresponding depressions formed in or defined on the receiving interface or inner sidewall of the tank or tanks, when the tank or tanks are fully rolled or slid into the assembly. Further, each protrusion may retract from the extended position to the retracted position as a tank is rolled or slid fully into the assembly.

In addition to aligning the tanks relative to the frame and the docking interface, the protrusions may additionally function to dampen the sliding or rolling of the tank or tanks into engagement with the docking interface to prevent inadvertent damage to the water inlet of the docking interface or the receiving interface of the tank. Specifically, the biasing force of the biasing mechanism or member may partially oppose the pressing of the protrusion into the retracted position to thereby provide the dampening effect.

In preferred embodiments, the pair of protrusions may be spring-loaded protrusions biased to protrude outwardly from the docking interface for engaging with and aligning a tank relative to the assembly and the docking interface.

As indicated above, at least one of the waste water tank and the clean water tank includes a receiving interface for mating with the docking interface of the mounting system of the assembly and fluidly connecting the tank to the assembly, preferably the clean water tank.

The receiving interface is preferably defined on the inner sidewall of the tank at or near the base wall for engagement with the corresponding docking interface.

As indicated, the receiving interface includes the outlet opening connectable to the water inlet of the docking interface. Typically, the receiving interface further includes one or more depressions configured to at least partially receive the one or more protrusions of the docking interface, preferably a pair of depressions located to either side of the outlet opening for receiving the pair of protrusions. Suitably, the depressions may be complementary-shaped to receive the protrusions.

The receiving interface may be of separate construction or may be integrally formed with the tank, preferably the latter.

In some embodiments, the assembly may further include a retaining mechanism for retaining engagement between the docking interface and the retaining interface, and preferably a fluid-tight connection between the water inlet and the outlet opening.

The retaining mechanism may be of any suitable size, shape and construction and may be associated with any one of the docking interface and the receiving interface, preferably the receiving interface. Likewise, the retaining mechanism may be of separate construction or may be integrally formed with the receiving interface, preferably the former.

In some embodiments, the retaining mechanism may include a sliding plate operatively associated with the receiving interface and configured to hook behind the shoulders of the pair of protrusions of the docking interface to retain the docking interface in engagement with the receiving interface.

The sliding plate may include a pair of opposed surfaces interconnected by opposing edges.

The opposed surfaces may include an outer surface and an opposed inner surface facing the receiving interface.

The opposing edges may include a lower edge, an opposed upper edge and a pair of opposed side edges.

The upper edge may include a pair of notches defined therein, each notch configured to fit around the cylindrical proximal portion of the protrusion behind the shoulder when the docking interface and receiving interface are connected.

The sliding plate may be slidably mounted in a vertical orientation at least partially in front of the receiving interface. The sliding plate may be vertically slidable from a raised engagement position to a lowered release position. The sliding plate may be slidably mounted to the receiving interface of the tank in any suitable way known in the art.

The retaining mechanism may further include one or more biasing mechanisms or members for biasing the sliding plate into the engagement position relative to the receiving interface. Movement of the sliding plate to the release position may work against the force of the biasing mechanism or member. The biasing mechanism or member may include one or more springs, such as, e.g., coil springs.

The retaining mechanism may further include an actuator or actuating mechanism for slidably moving the sliding plate to the release position.

Any suitable type of actuator or actuating mechanism may be used. The actuator or actuating mechanism may be manually actuated or by using a drive, preferably the former.

The actuator or actuating mechanism may include one or more of a lever, a ram, a tension cable, an operable handle or sliding arrangement for moving the sliding plate relative to the receiving interface.

In some embodiments, the actuator or actuating mechanism may include a cable and operable handle arrangement. A first end of the cable may be operatively associated with the lower edge of the sliding plate and an opposed second end of the cable may be operatively associated with the operable handle.

In use, movement of the operable handle may apply tension to the cable and cause the sliding plate to slide relative to the receiving interface at least partially towards the release position against the biasing force of the one or more biasing mechanisms or members. When the operable handle is released, the tension may be removed, and the sliding plate may be slid relative to the receiving interface to the engagement position under the force of the biasing force.

In some embodiments, the cable may extend from the first end operatively associated with the lower edge of the sliding plate underneath the base wall of the tank and at least partially along the outer sidewall of the tank to a height corresponding to a height of the operable handle mounted thereon, preferably the cable may extend between the outer side wall and the side panel mounted thereon to a height of the operable handle mounted to the side panel.

In some embodiments, the sliding plate may further include a bevelled or angled outer upper edge configured to facilitate the conical distal portion of the protrusions to ride over the bevelled or angled outer upper edge when the tank is rolled or slid into the assembly and the docking interface and the receiving interface are brought into engagement with one another. In such embodiments, the one or more biasing mechanisms or members may bias the sliding plate back into the engagement position once the shoulder of the protrusions has ridden over the bevelled or angled outer upper edge.

In other embodiments, the conical distal portion of each protrusion may be sufficient to facilitate the protrusions riding over the upper edge of the sliding plate when the tank is rolled or slid into the assembly and the docking interface and the receiving interface are brought into engagement with one another.

In some embodiments, the female quick connect fitting of the outlet opening may be operatively associated with the sliding plate of the retaining mechanism such that movement of the sliding plate to the release position may disengage or disassociate the female quick connect fitting of the outlet opening from the male quick connect fitting of the water inlet. The sliding plate may directly or indirectly disengage or disassociate the female quick connect fitting, preferably indirectly.

In some such embodiments, the female quick connect fitting may include an actuating member or mechanism associated with an outside collar portion of the female quick connect fitting for disengaging or disassociating a connection with a male quick connect fitting. The actuating member or mechanism may include one or more of a lever, an operable handle or a sliding arrangement for disengaging or disassociating a connection with a male quick connect fitting, preferably a sliding arrangement. In use, movement of the sliding plate to the release position may cause the sliding plate to come into contract with, and depress or move, at least part of the actuating member or mechanism of the female quick connect fitting thereby causing the release of the male quick connect fitting.

Conversely, return of the sliding plate back to the engagement position may remove any contact with the at least part of the actuating member or mechanism of the female quick connect thereby enabling the female quick connect fitting to connect with the corresponding male quick connect fitting.

In preferred embodiments, the sliding plate of the retaining mechanism may include a central opening defined therein through which the outlet opening may at least partially extend and be mounted for at least partially movement therewith between the release and engagement positions.

In some embodiments, the assembly may further include a power source for powering the pump and/or the water regulating arrangement as well as other electronic components of the assembly. The power source may be of any suitable form.

In some such embodiments, the power source may include an on-board power source, such as, e.g., one or more batteries or an electrical generator. The power source may be located within the housing.

In other such embodiments, the power source may include an external power source, such as, e.g., mains electricity. In such embodiments, the assembly may further include a socket for connecting with an external cable connectable to mains electricity. The socket and external cable may connect together using any suitable connection type, preferably an IP67 plug and socket receptable. The socket may preferably be located on the rear end of the assembly.

In some embodiments, the power source may preferably include an inverter for enabling the assembly to be compatible with mains electricity in different countries/regions having different voltages.

In some embodiments, the assembly may further include one or more power outlets connected to the power source for powering electrical accessories, such as, e.g., a blow dryer, a hair curler and/or a hair straightener. The one or more power outlets may be located in any suitable location on the assembly. Typically, however, the one or more power outlets may be located on an external surface of the frame for ease of access.

In some embodiments, the assembly may further include at least one light source for illuminating at least the basin.

The at least one light source may include any light source capable of illuminating the basin. For example, the at least one light source may include any one of a fluorescent lamp, a neon lamp, an incandescent lamp and a light-emitting diode ("LED").

Typically, the at least one light source may include a ring light having a mount for mounting the ring light relative to the upper surface of the frame for illuminating at least the basin.

The at least one light source may be electrically connected to and powered by the at least one power source, optionally via the one or more power outlets.

In some embodiments, the assembly may further include a filtration system for filtering water drawn from the source of clean water contained in the clean water tank.

The filtration system may be of any suitable type. For example, in some embodiments, the filtration system may include active charcoal provided in the clean water tank. Conversely, in other embodiments, the filtration system may include a granular-activated carbon filter. In yet other embodiments, the filtration system may include a filter cartridge fitted in line to the passage, pipe or tubing extending between the clean water tank and the at least one water outlet.

In some embodiments, the assembly may further include a controller for controlling operation of at least the pump (i.e., flowrate) and the water regulating arrangement (i.e., water temperature).

The controller may be of any suitable size, shape and configuration.

The controller may be a remote controller or may be associated with the assembly.

For example, in some embodiments, the controller may include one or more switches, dials or levers located on the assembly, preferably the upper surface. The one or more switches, dials or levers may be electronically connected to at least the pump, the water regulating arrangement and the at least one power source, preferably via a PCB board.

In other embodiments, the controller may include a touch screen interface in which a user may interact with the touch screen interface to control at least the pump, the water regulating arrangement and the at least one power source. The touch screen interface may be located on the assembly, preferably the upper surface. Again, the touch screen interface may be electronically connected to least the pump, the water regulating arrangement and the at least one power source, preferably via a PCB board. The touch screen interface may preferably include a Ip67 LCD touch panel display.

In some embodiments, the controller may include a display for displaying operating information of the assembly, such as, e.g., the water level in the tanks, the water temperature and/or the flow rate.

In some embodiments, the controller may further include at least one audio signalling device for generating at least one audio signal for alerting a user of error messages, for example. The audio signalling device may be in the form of a buzzer, a beeper, a chirper, a siren, a speaker or the like, and the at least one audio signal may be a buzz, a beep, a chirp, a siren or the like, for example. The audio signal may be a synthesized message or playback of a pre-recorded message, such as, e.g., "water level low" or "battery low". Preferably, the at least one audio signal may be a buzz, a beep, a siren or the like, or a combination thereof.

In some such embodiments, the at least one audio signalling device may be capable of emitting non alerts. For example, the at least one audio signalling device may be a speaker configured to playback music.

In yet other embodiments, the controller may be a remote controller configured to be held by a user, for example. The remote controller may be a wired or wireless remote. The remote controller may include one or more keys, buttons or dials for controlling various aspects of functionality of the assembly. Conversely, the remote controller may include a touch screen interface for controlling the various aspects of functionality of the assembly.

In some embodiments, the remote controller may be an external computing device, such as, e.g., a laptop or a desktop. In such embodiments, the device may further include software configured to be run on the computing device for controlling operation of the assembly. The software may preferably be interactive and allow a user to interact and control operation of the assembly, or at least the various aspects of functionality of the assembly.

In other embodiments, the remote controller may be mobile computing device, such as, e.g., a smart phone, a tablet or a smart watch. In such embodiments, the remote controller or device may further include software in the form of an application (i.e., an app) configured to run on the mobile computing device and allow a user to interact and control the assembly, or at least the various aspects of functionality of the assembly.

Apart from allowing a user to interact and control operation of the assembly, the software or app may further provide information, such as, e.g., water and energy usage.

In some embodiments, the portable basin assembly may include at least one modem configured to be in communication with the controller and the remote controller for the transmission of the data between the controller and the remote controller.

The at least one modem may be in communication with the remote controller either directly or indirectly via at least one remotely accessible server, for example. In some embodiments, the at least one modem may be a cellular modem. In other embodiments, the at least one modem may be a radio modem.

In some embodiments, the portable basin assembly may further include a wireless communications module, such as, e.g., a wireless network interface controller, such that the assembly may wirelessly connect to an external device, such as, e.g., a remote controller, via wireless network (e.g., Wi-Fi (WLAN) communication, Satellite communication, RF communication, infrared communication or Bluetooth™).

In some embodiments, the portable basin assembly may further include a dispensing assembly operatively associated with the at least one water outlet for dispensing a selected volume of at least one hair treatment product into the flow of water into the basin, preferably mixed in with the flow of water.

The at least one hair treatment product may include a shampoo, a conditioner or a combination thereof.

The dispensing assembly may be of any suitable size, shape and construction for dispensing the at least one hair product or a mixture of hair products into the at least one water outlet.

Generally, the dispensing assembly may include at least one source of hair treatment product and an outlet connectable to the at least one water outlet or the passage, pipe or tubing interconnecting the at least one water outlet with the source of clean water.

In some embodiments, the dispensing assembly may further include a valve to selectively control a flow of the at least one hair treatment product to the at least one water outlet.

Any suitable type of valve may be used. Typically, the valve may have a valve seat located within or associated with the outlet, a sealing member moveable into and out of engagement with the valve seat and an actuating mechanism for selectively moving the sealing member between open and closed positions.

The actuating mechanism may be as previously described and may preferably draw power from a power source as previously described.

In other embodiments, the dispensing assembly may further include a pump for pumping a selected volume of hair treatment product to the at least one water outlet via the outlet. The pump may be an electric pump. The pump may preferably draw power from a power source as previously described.

In such embodiments, a control for controlling the dispensing assembly may be located on the controller or the applicator associated with the at least one water outlet.

In some embodiments, the basin assembly may additionally, or alternatively, include a docking system for docking the assembly with any one of a source of clean water, a waste for receiving the waste of the basin and an external controller for controlling operation of the assembly.

The docking system may be any of suitable size, shape and/or configuration for interfacing a connection with any one of the source of clean water, the waste for receiving the waste of the basin and an external controller for controlling operation of the assembly.

Generally, the docking system may include an interface for interfacing a connection between the assembly and any one of the source of clean water, the waste for receiving the waste of the basin and an external controller for controlling operation of the assembly, preferably all three.

The interface may include three corresponding docks or ports for connecting with the source of clean water, the waste for receiving the waste of the basin and an external controller for controlling operation of the assembly. The three docks or ports may preferably be located on the rear end of the frame of the assembly, although it is envisaged that the docks or ports may also be located on the bottom, top, opposed sides or front end of the frame of the assembly. The source of clean water, the waste for receiving the waste of the basin and an external controller may include corresponding plugs configured to be at least partially received in the docks or ports. Connection of the plugs with the docks/ports may provide fluid-tight connections.

In some such embodiments, the source of clean water, the waste for receiving the waste of the basin and the external controller may be housed within a separate unit configured to plug into the assembly via the interface as previously described.

In some such embodiments, the separate unit may additionally house the pump, the water regulating arrangement, the controller and/or the source of power. In such embodiments, it is envisaged that the assembly will not operation unless it is plugged/docked with the separate unit.

According to a fourth aspect of the present invention, there is provided a method of mounting at least one of a waste water tank and a clean water tank to a portable basin assembly, said method including:

aligning and moving the tank relative to the assembly such that the tank at least partially abuts with at least one alignment member of a mounting system of the portable basin assembly for alignment relative to a frame and docking interface of the assembly; and pressing the tank into the docking interface for fluidly connecting the at least one of the waste water tank to receive waste water from a waste of a basin of the assembly and the clean water tank for providing a source of clean water.

The method may include one or more characteristics or features of the portable basin assembly, the mounting system, and/or the tank as hereinbefore described.

In some embodiments, the aligning and moving may further include opening a door located on at least one of the sides of the assembly for access to the at least one alignment member and the docking interface.

In other embodiments, the aligning and moving may further include aligning the tank relative to the tank receiving opening defined in the side of the assembly.

The aligning may further include orientating the tank such that inner sidewall faces the docking interface.

The pressing may further include sliding or rolling the tank into the assembly such that the docking interface and the receiving interface are brought into engagement with one another.

In some embodiments, the pressing may include sliding or rolling the tank into the assembly until the side panel mounted to the outer sidewall of the tank rests flush with a remainder of the housing.

In preferred embodiments, sliding of the retaining mechanism into engagement with the docking interface may provide both audible and tactile feedback to a user that the tank is fully connected to the assembly.

According to a fifth aspect of the present invention, there is provided a method of rinsing and/or washing a person's hair, said method including:

positioning a head of the person over a basin of a portable basin assembly in accordance with the first aspect; and directing a flow of water over the person's hair to rinse and/or wash the hair.

The method may include one or more characteristics or features of the portable basin assembly, the mounting system and/or the tank as hereinbefore described.

Any of the features described herein can be combined in any combination with any one or more of the other features described herein within the scope of the invention.

The reference to any prior art in this specification is not and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows.

DETAILED DESCRIPTION

FIGS. 1 to 8 show a portable basin assembly (100) and parts thereof according to an embodiment of the present invention.

Figure 1:
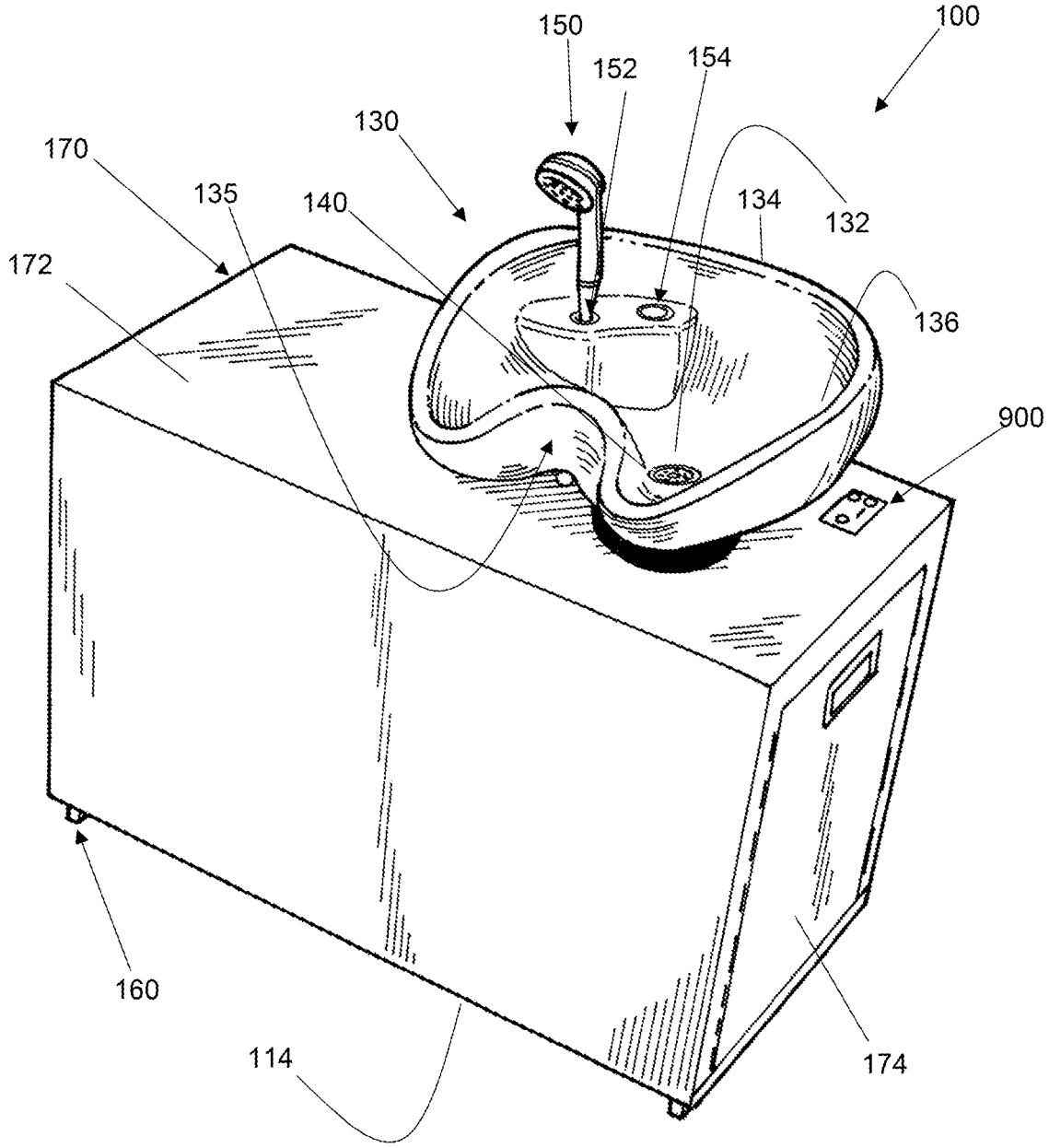
FIG. 1 is an upper perspective view of a portable basin assembly according to an embodiment of the present invention.

Referring to FIG. 1, the portable basin assembly (100) includes a frame (110; not visible); a basin (130) having a waste (140) mounted atop the frame (110; not visible); at least one water outlet in the form of an applicator (150) and hose (152) for directing a flow of water into the basin (130); at least one waste water tank (310; not visible) and at least one clean water tank (410; not visible); and a mounting system (210; not visible) for mounting the waste water tank (310; not visible) and the clean water tank (410; not visible) to the assembly (100).

Figure 3:
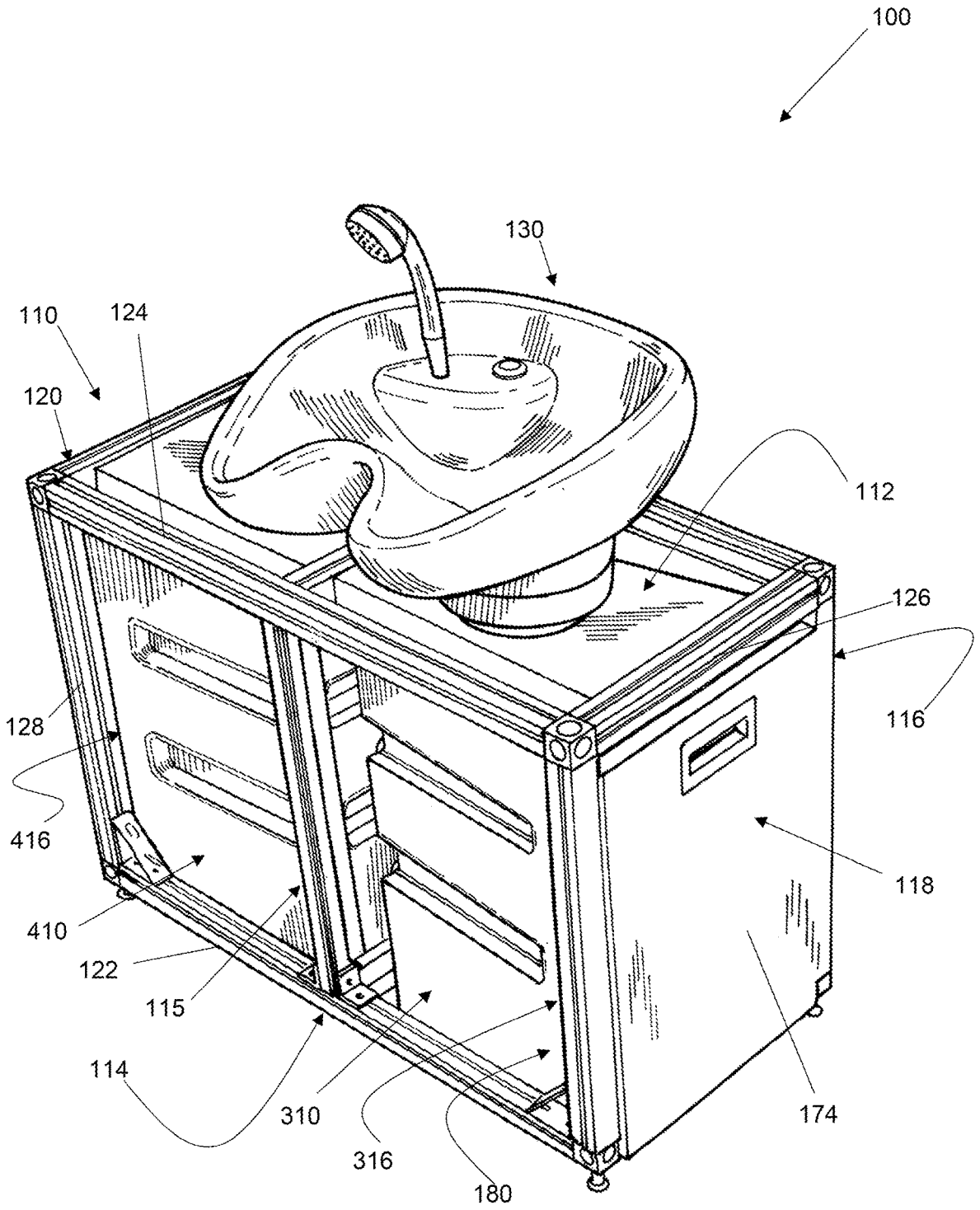
FIG. 3 is an upper perspective view of the portable basin assembly as shown in FIGS. 1 and 2 with the housing removed to show the fitted waste water and clean water tanks.

Referring briefly to FIG. 3, the frame (110) is formed from metal.

The frame (110) defines an upper surface (112) atop which the basin (130) is mounted, an opposed lower surface (114), a front end (115), an opposed rear end (116) and opposed sides (118) of the assembly (100).

The frame (110) is formed from a plurality of frame members (120) joined together. Specifically, the frame (110) includes a lower pair of longitudinally extending frame members (122) extending between the opposed sides (118) and defining the lower surface (114) and an upper pair of longitudinally extending frame members (124) extending between the opposed sides (118) and defining the upper surface (112).

The lower and upper pairs of longitudinally extending frame members (122, 124) together define the front and rear ends (115, 116).

Each pair of longitudinally extending frame members (122, 124) is joined together by one or more transversely extending cross frame members (126).

Further, the pairs of longitudinally extending frame members (122, 124) are joined to one another by vertical frame members (128) defining a height of the frame (110).

The various frame members (120) are joined together using conventional means, such as, e.g., one or more mechanical fasteners and joining components.

The frame members (120) are each of a tubular construction with a substantially rectangular cross section.

Referring back to FIG. 1, the frame (110; not visible) includes one or more feet (160) for supporting the frame (110; not visible) and other components of the assembly (100) atop a support surface.

The feet (160) are mounted to the lower surface (114) of the frame (110; not visible). The frame (110; not visible) includes four feet (160) with each foot (160) being located at or near a corner of the frame (110; not visible).

Each foot (160) is height adjustable, for example by rotating the foot (160) relative to the frame (110).

As shown, the assembly (100) further includes a housing (170) having one or more panels (172) mounted to the frame (110; not visible) for concealing internal features of the assembly (100) and/or providing a desired aesthetic look.

The panels (172) are made of wood, plastic or metal material or materials and are fastened to the frame (110; not visible) with one or more mechanical fasteners as known in the art.

Referring again briefly to FIG. 3, the frame (110) and the housing (170; not shown) of the assembly (100) together define opposing tank receiving bays (180) located at each side (118) of the frame (110) each configured to receive a tank (310, 410) therein.

Referring again to FIG. 1, the basin (130) is a ceramic basin.

The basin (130) includes a base (132) having the waste (140), a rim (134) and at least one sidewall (136) extending upwardly from the base (132) to the rim (134). The rim (134) extends from an upper portion of the at least one sidewall (136) and extends along an edge of the at least one sidewall (136).

The waste (140) is centrally located within the base (132).

As shown, the rim (134) and/or the at least one sidewall (136) of the basin (130) further define at least one recessed rim portion (135). The at least one recessed rim portion (135) is sized and shaped to receive or at least partially accommodate the back of a neck of a person having his or her hair washed or rinsed in the basin (130).

Figure 2:
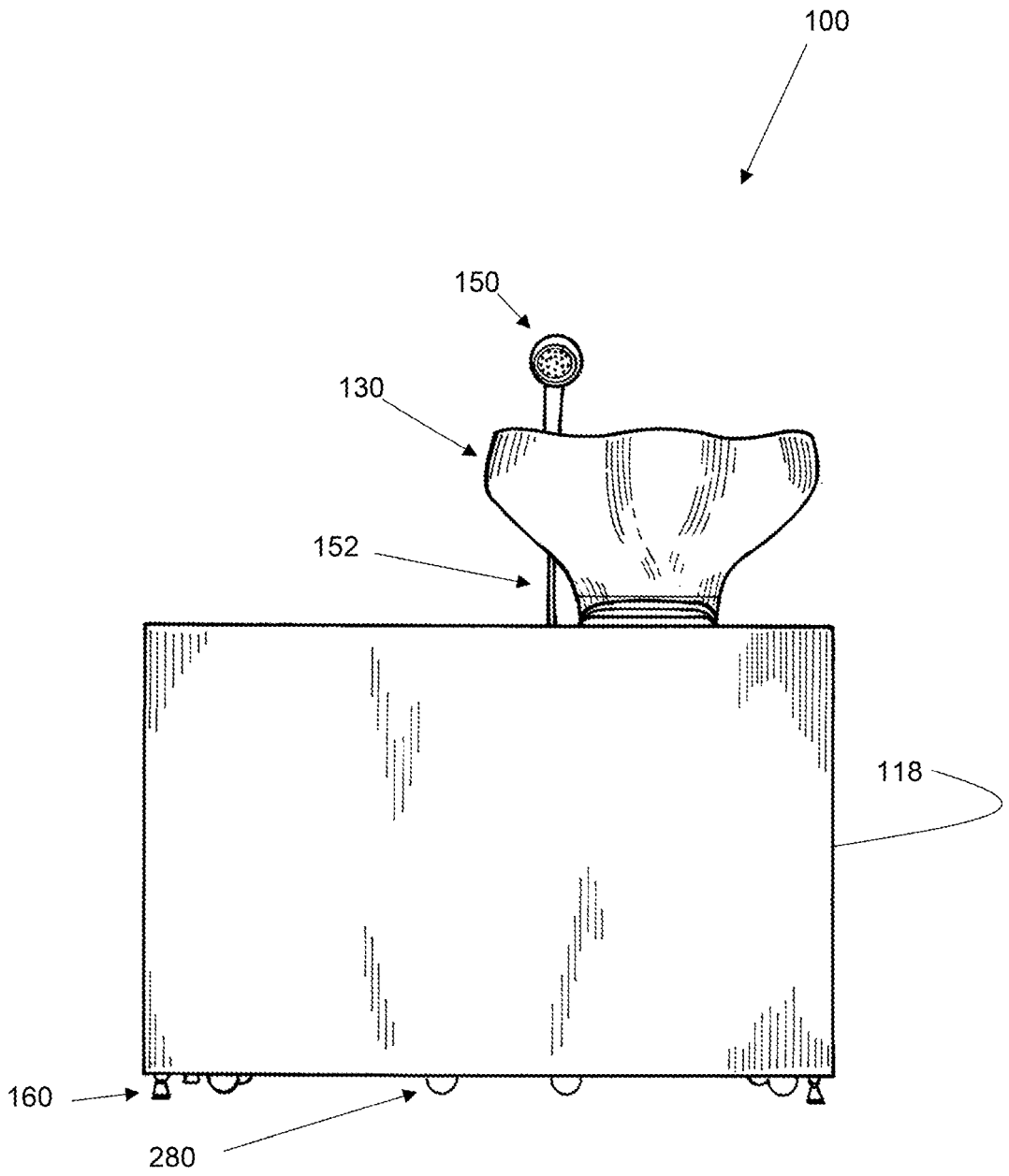
FIG. 2 is a front view of the portable basin assembly as shown in FIG. 1.

Referring to FIG. 2, the basin (130) is mounted atop the frame (110; not visible) near one of the opposed sides (118) of the frame (110; not visible).

The basin (130) is pivotally mounted atop the frame (110; not visible) such that the basin (130) is tiltable about a vertical axis and so that the basin (130) is tiltable towards and away from a person having his or her hair rinsed and/or washed.

As indicated, at least one water outlet in the form of an applicator (150) and hose (152) is operatively associated with the basin (130). The applicator (150) and hose (152) are in fluid communication with the clean water tank (410; not visible) containing a source of clean water via a pump (610; shown in FIG. 6) and a water regulating arrangement (620; shown in FIG. 6) configured to maintain a flow of clean water into the basin (130) at a desired temperature.

Figure 6:
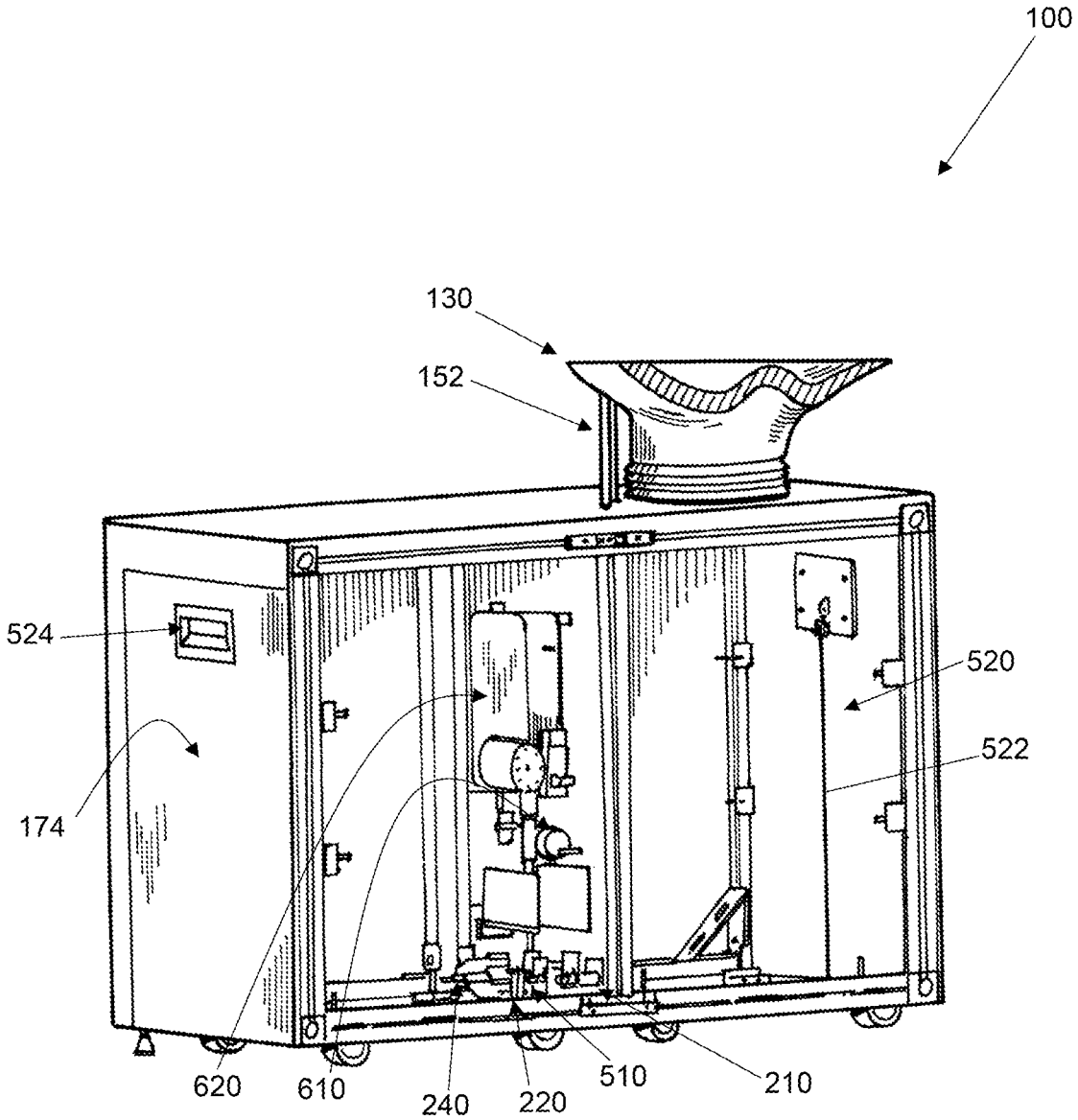
FIG. 6 is an upper perspective, sectional view of the portable basin assembly as shown in FIGS. 1 and 2 with the tanks removed.

Referring to FIG. 1, the flow of water through the applicator (150) and hose (152) is selectively controlled by selective control of the pump (610; shown in FIG. 6). In this regard, a push button (154) provided in the basin (130) and operatively associated with the pump (610; shown in FIG. 6) is configured to activate and deactivate the pump (610; shown in FIG. 6) and thereby selectively control the flow of water through the applicator (150) and hose (152).

Figure 4:
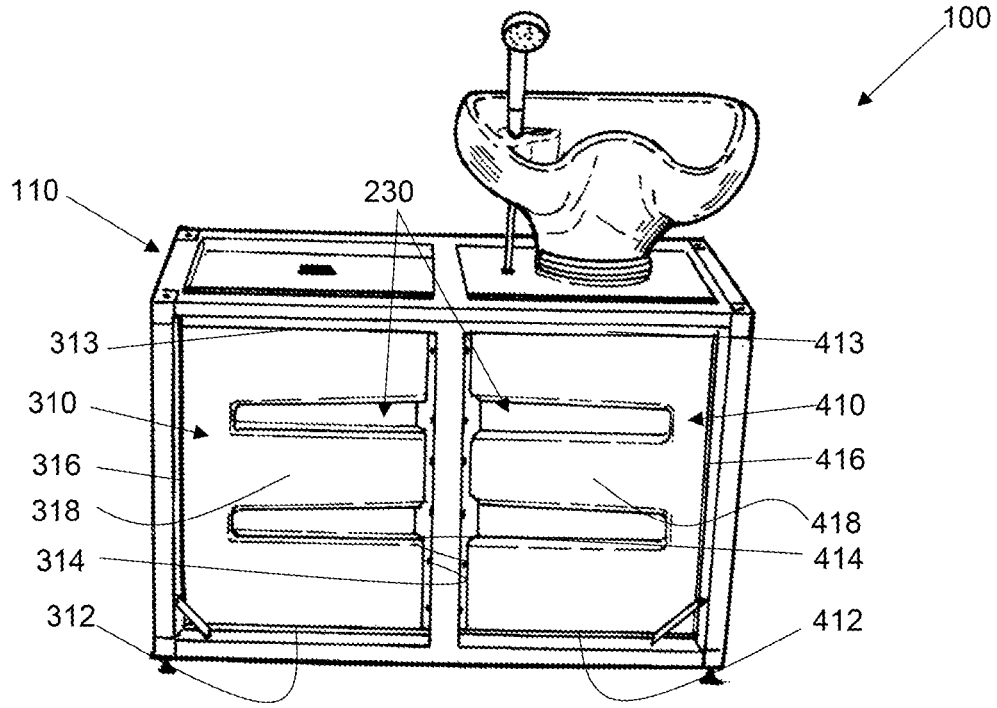
FIG. 4 is a front view of the portable basin assembly as shown in FIG. 3.

Referring to FIG. 4 and as indicated, the assembly (100) includes at least one waste water tank (310) and at least one clean water tank (410).

Each tank (310, 410) is formed of plastic and has a cuboidal shape.

The tanks (310, 410) are configured to be fully received within the frame (110) via the mounting system (210), which will be described later. The tanks (310, 410) are arranged in a side-by-side arrangement with the waste water tank (310) positioned beneath the waste (140; not visible) for fluidly receiving waste water therefrom.

Each tank (310, 410) includes a base wall (312, 412), an opposed upper wall (313, 413) and four sidewalls extending therebetween. The four sidewalls include an inner sidewall (314, 414) configured to be received first in the assembly (100), an opposed outer sidewall (316, 416) and opposed side sidewalls (318, 418).

Referring briefly to FIG. 3, each tank (310, 410) has a side panel (174) mounted to the outer sidewall (316, 416) with one or more mechanical and/or chemical fasteners. As shown in FIG. 1, the side panel (174) sits flush with a remainder of the housing (170) of the assembly (100) when the tank (310; not visible) to which the panel (174) is mounted is fully received within the frame (110; not visible) of the assembly (100).

Figure 5:
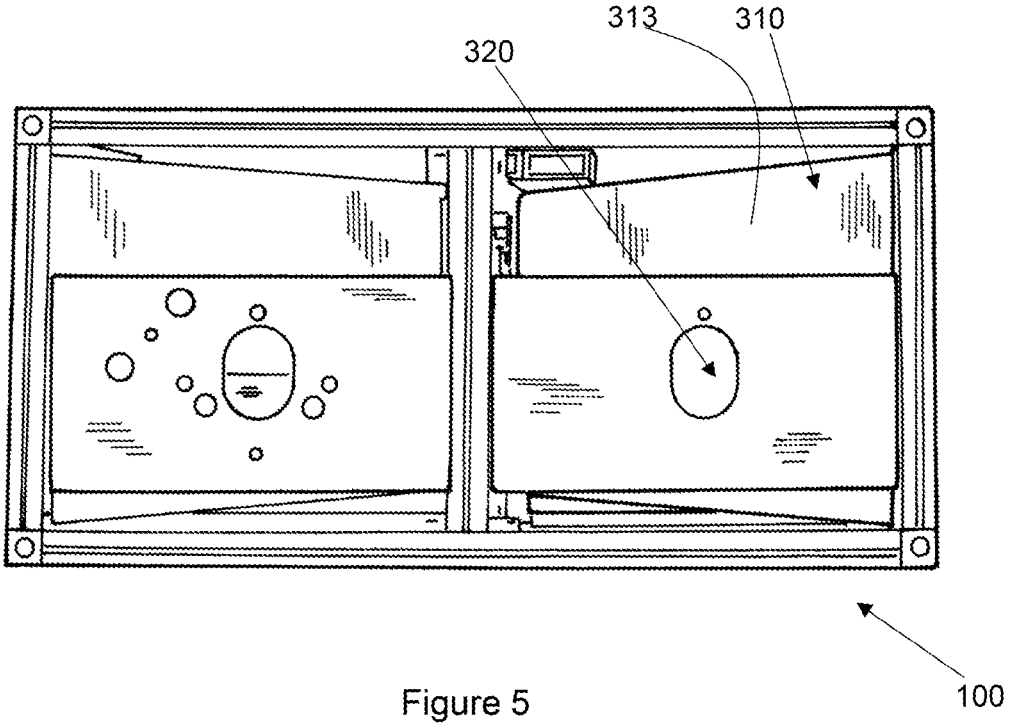
FIG. 5 is a top view of the portable basin assembly as shown in FIGS. 1 to 4 with the housing, basin and water outlet removed.

Referring to FIG. 5, at least the waste water tank (310) includes a first inlet opening (320) for receiving waste water from the waste (140; not shown) of the basin (130; not shown). The first inlet opening (320) is defined in the upper wall (313) of the tank (310).

In use, the first inlet opening (320) aligns with the waste (140; not shown) of the basin (130; not shown) and/or a passage, pipe or tubing extending therefrom so that waste water can readily drain into the tank (310) from the waste (140; not visible) of the basin (130; not visible) via the first inlet opening (320).

Figure 7:
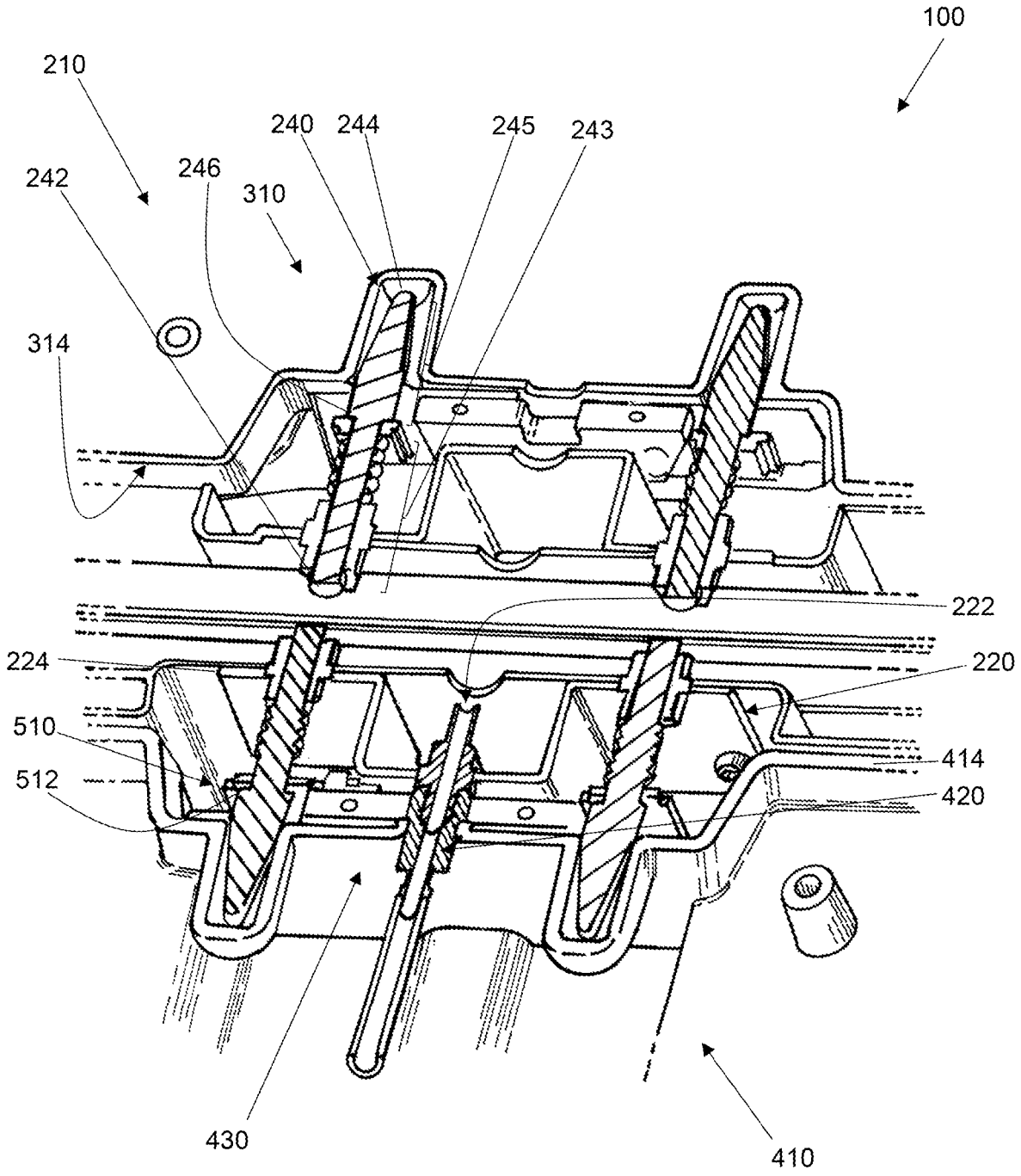
FIG. 7 is a sectional view of part of a docking interface, a receiving interface and a retaining mechanism of the assembly for docking and fluidly connecting the tanks to the assembly.
Figure 8:
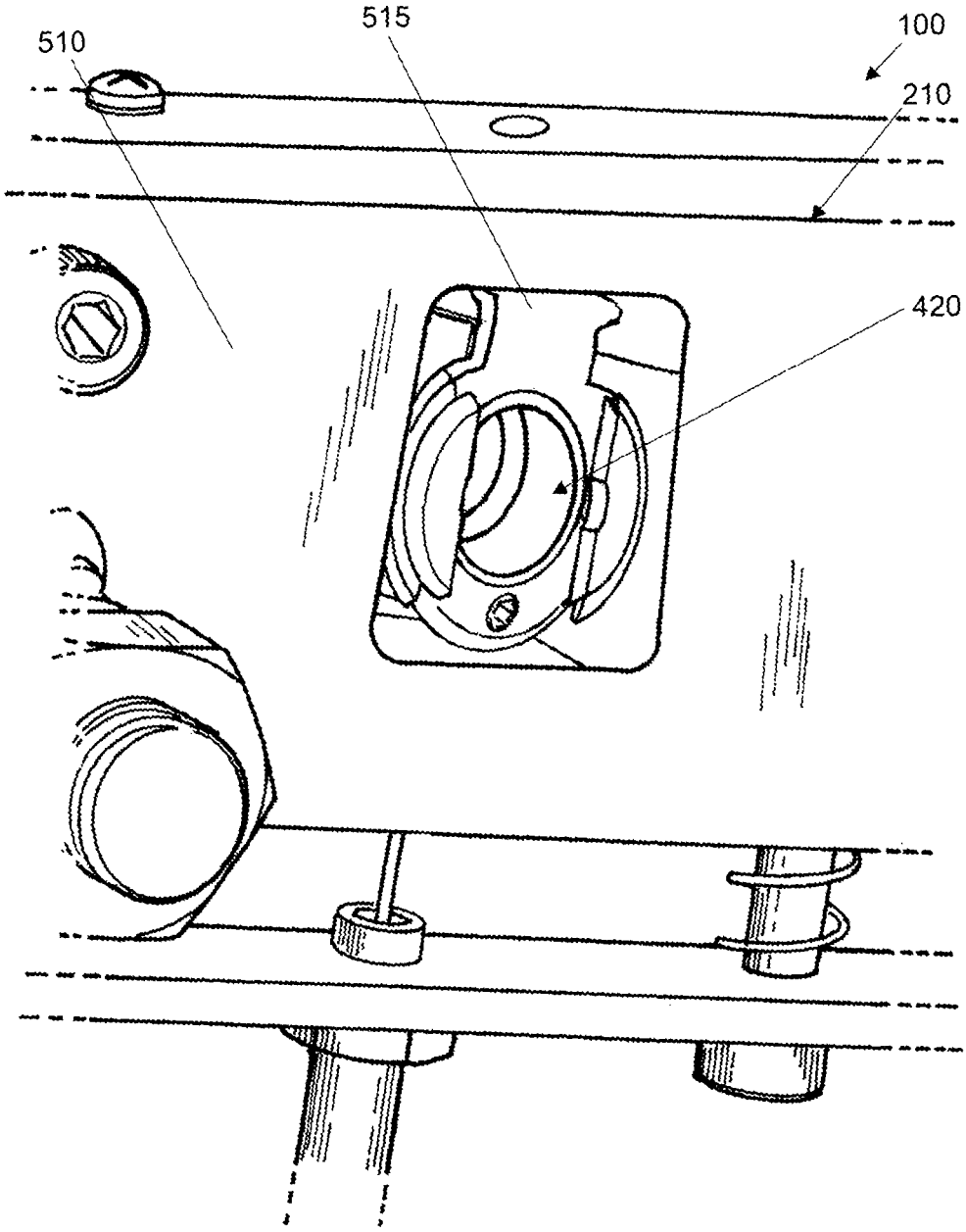
FIG. 8 is a view of part of the receiving interface and retaining mechanism of the assembly shown in FIG. 7.

Referring briefly to FIGS. 7 and 8, the clean water tank (410; shown only in FIG. 7) includes an outlet opening (420) in the form of a female quick connect fitting for providing a flow of clean water to the at least one water outlet. The outlet opening (420) is located on a lower portion of the inner sidewall (414; shown only in FIG. 7) near the base wall (412; shown only in FIG. 7).

Best shown in FIG. 8, the female quick connect fitting (420) includes at least one sealing member to facilitate engagement of the outlet opening (420) when the tank (410; shown only in FIG. 7) is mounted via the mounting system (210). This will be described in detail later.

Further, the female quick connect fitting of the outlet opening (420) includes a valve (not visible) for closing the outlet opening (420) when not fluidly connected to the assembly (100).

Referring to FIG. 2, each of the tanks (310, 410; not visible) includes four caster wheels (280) mounted to an underside of the base wall (312, 412; not visible) for moving each tank (310, 410; not visible) along a support surface and for sliding the tanks (310, 410; not visible) into and out of engagement with the assembly (100) via the mounting system (210; not visible).

Advantageously, the assembly (100) can be conveyed across the support surface by the wheels (280) mounted to the underside of each tank (310, 410; not visible). In such embodiments, the feet (160) mounted to the frame (110; not visible) are raised prior to moving the assembly (100) and then lowered to re-engage the support surface once the assembly (100) is parked in a desired location.

Referring to FIG. 6 and as mentioned, the assembly (100) includes a mounting system (210) for mounting at least one waste water tank (310; not visible) and at least one clean water tank (410; not visible) to the assembly (100).

The mounting system (210) mounts the waste water tank (310; not visible) to the assembly (100) such that the first inlet opening (320; not visible) is positioned beneath the waste (140; not shown) of the basin (130) for receiving waste water.

The mounting system (210) mounts the clean water tank (410; not visible) to the assembly (100) so that the outlet opening (420; not visible) is in fluid communication with the applicator (150; not shown) and hose (152) of the at least one water outlet for directing a flow of water into the basin (130).

Referring to FIG. 7, the mounting system (210) includes a docking interface (220) for docking with a receiving interface (430) provided on the clean water tank (410) and fluidly connecting the clean water tank (410) to the assembly (100).

The receiving interface (430) includes the outlet opening (420) as previously described. The docking interface (220) includes a water inlet (222) configured to mate with and connect to the outlet opening (420) of the receiving interface (430).

Referring briefly to FIG. 8, the water inlet (222; not shown) and the outlet opening (420) are connectable by a quick connect fitting arrangement. The water inlet (222; not shown) includes a male quick connect fitting and the outlet opening (420) includes female quick connect fitting connectable to the male quick connect fitting of the water inlet (222; not shown) for fluidly connecting them together.

Referring back to FIG. 7, the water inlet (222) include one or more sealing members extending at least partially about the plug formation, such as, e.g., washers, to form a fluid-tight seal when inserted into the outlet opening (420).

In use, when the clean water tank (410) is aligned and rolled into the assembly (100), the water inlet (222) of the docking interface (210) is inserted into the outlet opening (420) of the tank (410) thereby allowing the source of clean water to exit the tank (410) via the outlet opening (420) and be conveyed to the at least one water outlet via the pump (610; shown in FIG. 6) and the water regulating arrangement (620; shown in FIG. 6).

The docking interface (220) further includes a bracket (224) on which the water inlet (222) is mounted. The bracket (224) includes a stepped central portion on which the water inlet (222) is be mounted so that the water inlet (222) protrudes forward of the docking interface (220) for at least partial insertion into the corresponding outlet opening (420) of the tank (410).

The mounting system (210) further includes alignment members for aligning both the waste water tank (310) and the clean water tank (410) relative to the frame (110; not shown) and for aligning the clean water tank (410) relative to the docking interface (220).

Referring briefly to FIG. 4, alignment members in the form of two pairs of opposed protruding ridges are provided on an inner surface of the front and rear ends (115, 116). The protruding ridges protrude inwards and extend at least partially across a central portion of the inner surfaces of both the front and rear ends (115, 116) of the assembly (100).

Corresponding grooves (230) are defined at least partially along the opposed side sidewalls (318, 418) of the tanks (310, 410) and extending from the inner sidewalls (314, 414) at least partially towards the outer sidewalls (316, 416).

In use, the grooves (230) are configured to align relative to and at least partially receive the protruding ridges when the tanks (310, 410) are inserted into the assembly (100) to thereby align the tanks (310, 410) relative to the assembly (100).

Referring to FIG. 6, further alignment members in the form of protrusions (240) protrude outwards from the docking interface (220) and a central divide between the tanks (310, 410; not shown).

Referring to FIG. 7, the protrusions (240) are configured to align relative to and be at least partially received within corresponding depressions formed in the receiving interface (430) of the clean water tank (410) and the inner sidewall (314) of the waste water tank (310), when the tanks (310, 410) are fully rolled into the assembly (100).

Each protrusion (240) includes a pair of opposed ends and an elongate body extending therebetween.

The pair of opposed ends include a proximal end (242) slidably mounted to the docking interface (220) or the central divide and an opposed distal end (244).

The elongate body includes a cylindrical proximal portion (243) and a conical distal portion (245) that tapers towards the distal end (244). The proximal portion (243) and the distal portion (245) are delineated by a shoulder (246) of greater diameter than the proximal portion (243).

Each protrusion (240) is slidable between a retracted position and an extended position. Each protrusion (240) is spring-mounted so that movement to the retracted position works against the force of a biasing member in the form of a coil spring mounted about the proximal portion (243) between the docking interface or central divide and the shoulder (246) of the protrusion (240).

As indicated, each protrusion (240) is configured to align relative to and be at least partially received in corresponding depressions formed in or defined on the receiving interface (430) or the inner sidewall (314) of the clean water tank (410) and the waste water tank (310), respectively, when the tanks (310, 410) are fully rolled into the assembly (100).

In addition to aligning the tanks (310, 410) relative to the frame (110; not shown) and the docking interface (220), the protrusions (240) additionally function to dampen the rolling of the tanks (310, 410) into engagement and prevent inadvertent damage.

As indicated above, the clean water tank (410) includes the receiving interface (430) for mating with the docking interface (220) of the mounting system (210) of the assembly (100) and fluidly connecting the tank (410) to the assembly (100).

The receiving interface (430) is defined on the inner sidewall (414) of the tank (410) at or near the base wall (412; not shown) for engagement with the corresponding docking interface (220).

The receiving interface (430) includes the outlet opening (420) connectable to the water inlet (222) of the docking interface (220) as well as the corresponding depressions for receiving the protrusions (240).

The assembly (100) further includes a retaining mechanism for retaining engagement between the docking interface (220) and the retaining interface (430) as well as between the waste water tank (310) and the protrusions (240) extending from the central divide.

The retaining mechanism includes a sliding plate (510) operatively associated with the receiving interface (430) of the clean water tank (410) and a portion of the inner side wall (314) of the waste water tank (310) and configured to hook around the shoulder (246) of the corresponding protrusions (240) to retain engagement between the tanks (310, 410) and the assembly (100).

Each sliding plate (510) includes a pair of notches (512) defined in an upper edge configured to each fit around the cylindrical proximal portion (243) of a corresponding protrusion (240) behind the shoulder (246) to retain engagement between the sliding plate (510) and the protrusion (240).

Each sliding plate (510) is slidably mounted in a vertical orientation and vertically slidable from a raised engagement position to a lowered release position. The sliding plate (510) is biased into the raised engagement position by one or more biasing mechanisms or members. Movement of the sliding plate (510) to the release position works against the force of the one or more biasing mechanisms or members.

Referring to FIG. 6, an actuating mechanism in the form of an operable handle and cable arrangement (520) is operatively associated with each sliding plate (510) and configured to slidably move the sliding plate (510) to the release position.

A first end of a cable (522) of the arrangement (520) is operatively associated with a lower edge of the sliding plate (510) and an opposed second end of the cable (522) is operatively associated with an operable handle (524) of the arrangement (520).

In use, movement of the operable handle (524) applies tension to the cable (522) and causes the sliding plate (510) to slide at least partially towards the release position against the biasing force thereby release any retained protrusion (240). When the operable handle (524) is released, the tension is released, and the sliding plate (510) slides back to the engagement position under the force of the biasing force.

As shown, the cable (522) extends from the first end operatively associated with the lower edge of each sliding plate (510) underneath the base wall (312, 412; not shown) of the tanks (310, 410; not shown) and at least partially along the outer sidewall (316, 416; not shown) of the tanks (310, 410; not shown) to a height corresponding to a height of the operable handle (524) mounted thereon. The cable (522) extends between the outer side wall (316, 416; not shown) of each tank (310, 410) and the side panel (174) mounted thereon to a height of the operable handle (524) mounted to the side panel (174).

Referring again to FIG. 8, in some embodiments, the female quick connect fitting of the outlet opening (420) is operatively associated with the sliding plate (510) of the retaining mechanism such that movement of the sliding plate (510) to the release position also disengages or disassociates the female quick connect fitting of the outlet opening (420) from the male quick connect fitting of the water inlet (222; not shown).

Specifically, and as shown, movement of the sliding plate (510) into the release position causes the sliding plate (510) to come into contact with, and depress or move, at least part of a release actuating member or mechanism of the female quick connect fitting thereby causing release of the male quick connect fitting.

As shown, the sliding plate (510) includes a central opening (515) through which the outlet opening (420) at least partially extends and is mounted thereto for at least partial movement therewith between the release and engagement positions.

Referring back to FIG. 1, the assembly (100) further includes a touch screen interface (900) for controlling operation of at least the pump (i.e., flowrate) and the water regulating arrangement (i.e., water temperature). The touch screen interface (900) further includes a display for displaying operating information of the assembly (100), such as, e.g., the water level in the tanks (310, 410; not shown), the water temperature and/or the flow rate.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A portable basin assembly comprising:

a frame;

a basin having a waste mounted atop the frame;

at least one water outlet for directing a flow of water into the basin; and a mounting system for mounting at least one of a waste water tank and a clean water tank to the assembly, said mounting system comprising:

a docking interface for docking with a receiving interface provided on the at least one of the waste water tank and the clean water tank and fluidly connecting at least one of the waste water tank to receive water from the waste of the basin and the clean water tank for providing a source of clean water; and at least one alignment member for aligning the at least one of the waste water tank and the clean water tank relative to the frame and the receiving interface of the at least one of the waste water tank and the clean water tank relative to the docking interface for docking when the at least one of the waste water tank and the clean water tank is mounted relative to the assembly, said at least one alignment member comprising a pair of opposed protruding ridges protruding inwards from an inner surface of a front end and opposed rear end of the frame for aligning relative to and being at least partially received in corresponding grooves defined along opposed sidewalls of at least one of the waste water tank and the clean water tank.

2. The assembly of claim 1, further comprising one or more panels mounted on an upper surface and front and rear ends of the frame.

3. The assembly of claim 2, further comprising the clean water tank for providing the source of clean water and the waste water tank for receiving water from the waste of the basin.

4. The assembly of claim 3, wherein each of the tanks further comprises a side panel mounted thereon configured to form a housing for the assembly together with the one or more panels mounted on the upper surface and front and rear ends of the frames.

5. The assembly of claim 3, wherein the docking interface is configured to dock with, and fluidly connect with the receiving interface of the clean water tank.

6. The assembly of claim 5, wherein the receiving interface comprises an outlet opening and the docking interface comprises a water inlet connectable to the outlet opening for forming a fluid-tight connection.

7. The assembly of claim 6, wherein the water inlet comprises a male connection fitting connectable to female connection fitting associated with the outlet opening.

8. The assembly of claim 6, wherein, in use, when the clean water tank is aligned and slid, or rolled, into the assembly, the male connection fitting of the water inlet is inserted into the female connection fitting of the outlet opening thereby allowing a source of clean water to exit the tank via the outlet opening and be conveyed to the at least one water outlet via pump.

9. The assembly of claim 6, wherein the at least one alignment member aligns the clean water tank relative to the frame and the docking interface and the waste water tank relative to the frame.

10. The assembly of claim 9, wherein the corresponding grooves are defined along opposed sidewalls of the clean water tank and the waste water tank.

11. The assembly of claim 10, wherein the at least one alignment member further comprises a pair of protrusions protruding from the docking interface on opposing sides of the water inlet.

12. The assembly of claim 11, wherein the pair of protrusions are mounted to a base mount mounted to the docking interface and the protrusions are slidable relative to the base mount between retracted and extended positions.

13. The assembly of claim 12, wherein the pair of protrusions are configured to align relative to and be at least partially received in corresponding depressions formed in, or defined on, the receiving interface of the clean water tank when the tank is fully rolled, or slid, into the assembly.

14. The assembly of claim 13, wherein the protrusions retract from the extended position to the retracted position as the tank is rolled, or slid, into the assembly.

15. The assembly of claim 14, wherein movement of the protrusions from the extended position to the retracted position at least partially dampens sliding or rolling of the tank into engagement with the docking interface.

16. The assembly of claim 11, further comprising a retaining mechanism for retaining engagement between the docking interface and the receiving interface.

17. The assembly of claim 16, wherein the retaining mechanism comprises a sliding plate operatively associated with the receiving interface and configured to hook behind shoulders of the pair of protrusions of the docking interface to retain the docking interface in engagement with the receiving interface.

18. The assembly of claim 1, wherein the mounting system is configured to fluidly connect the clean water tank with the at least one water outlet and the waste water tank with the waste of the basin.

19. The assembly of claim 1, wherein the mounting system is configured to enable the waste water tank and the clean water tank to be slid or rolled into, or out of, the frame of the assembly.

20. A method of mounting at least one of a waste water tank and a clean water tank to a portable basin assembly, said method comprising:

aligning and moving the tank relative to the assembly such that the tank at least partially abuts with at least one alignment member of a mounting system of the portable basin assembly for alignment of the tank relative to a frame and a receiving interface of the tank relative to a docking interface of the assembly, said at least one alignment member comprising a pair of opposed protruding ridges protruding inwards from an inner surface of a front end and opposed rear end of the frame for aligning relative to and being at least partially received in corresponding grooves defined along opposed sidewalls of the at least one of the waste water tank and the clean water tank; and pressing the tank into the docking interface for docking the receiving interface with the docking interface and fluidly connecting at least one of the waste water tank to receive waste water from a waste of a basin of the assembly and the clean water tank for providing a source of clean water.

* * * * *